US008274467B2

(12) United States Patent
Qi et al.

(10) Patent No.: US 8,274,467 B2
(45) Date of Patent: Sep. 25, 2012

(54) LIQUID CRYSTAL DISPLAY HAVING CONTROL CIRCUIT FOR DELAY GRADATION VOLTAGES AND DRIVING METHOD THEREOF

(75) Inventors: Xiao-Jing Qi, Shenzhen (CN); Yuan Li, Shenzhen (CN)

(73) Assignees: Innocom Technology (Shenzhen) Co., Ltd., Shenzhen, Guangdong Province (CN); Chimei Innolux Corporation, Miaoli County (TW)

( * ) Notice: Subject to any disclaimer, the term of this patent is extended or adjusted under 35 U.S.C. 154(b) by 1330 days.

(21) Appl. No.: 11/999,102

(22) Filed: Dec. 3, 2007

(65) Prior Publication Data

US 2008/0129722 A1 Jun. 5, 2008

(30) Foreign Application Priority Data

Dec. 1, 2006 (TW) ..... 95144735 A

(51) Int. Cl.
*G09G 3/36* (2006.01)

(52) U.S. Cl. ..... 345/99; 345/89

(58) Field of Classification Search ..... 345/55, 345/98, 100, 102, 204, 211, 690
See application file for complete search history.

(56) References Cited

U.S. PATENT DOCUMENTS

| | | | | |
|---|---|---|---|---|
| 7,133,034 | B2 | 11/2006 | Park et al. | |
| 7,283,113 | B2 | 10/2007 | Ham | |
| 7,488,996 | B2 * | 2/2009 | Chang | 257/208 |
| 2005/0134538 | A1 * | 6/2005 | Aoki | 345/87 |

FOREIGN PATENT DOCUMENTS

| | | | |
|---|---|---|---|
| CN | 1407534 | A | 4/2003 |
| JP | 2002-189437 | A | 7/2002 |

* cited by examiner

*Primary Examiner* — Quan-Zhen Wang
*Assistant Examiner* — Calvin C Ma
(74) *Attorney, Agent, or Firm* — WPAT, PC; Justin King

(57) ABSTRACT

An exemplary liquid crystal display (LCD) (200) includes an LCD panel having a plurality of display regions (240) arranged sequentially; a plurality of gate driving circuit (250) respectively connected to the display regions for providing scan signal to scanning the display region; at least a data driving circuit (230) for generating gradation voltages and providing the gradation voltages to the corresponding scanned display region; and a delay control circuit connected between the data driving circuit and the display regions for delaying the gradation voltages provided to each display region. The sum of the first delay value generated by the delay control circuit when the gradation voltages are applied to one of the display regions and the second delay value of the same gradation voltages being generated when the gradation voltages are transmitted from the gate driving circuit to the same one of the display regions is approximately constant for all of the display regions.

18 Claims, 3 Drawing Sheets

LIQUID CRYSTAL DISPLAY HAVING CONTROL CIRCUIT FOR DELAY GRADATION VOLTAGES AND DRIVING METHOD THEREOF

FIELD OF THE INVENTION

The present invention relates to liquid crystal displays (LCDs), and particularly to an LCD having a delay control circuit for delay gradation voltages.

GENERAL BACKGROUND

A typical LCD has the advantages of portability, low power consumption, and low radiation. LCDs have been widely used in various portable information products, such as notebooks, personal digital assistants (PDAs), video cameras and the like. Furthermore, the LCD is considered by many to have the potential to completely replace CRT (cathode ray tube) monitors and televisions.

FIG. 2 is essentially an abbreviated circuit diagram of a typical LCD 100. The LCD 100 includes an LCD panel 110, a number of data driving circuits 130, and a number of gate driving circuits 150. The LCD panel 110 includes a first substrate (not shown), a second substrate (not shown) arranged parallel to the first substrate, and a liquid crystal layer (not shown) sandwiched between the first substrate and the second substrate. Liquid crystal material of the liquid crystal layer has anisotropic transmittance.

The first substrate includes a number of gate lines 112 that are parallel to each other and that each extend along a first direction, and a number of data lines 114 that are parallel to each other and that each extend along a second direction orthogonal to the first direction. The intersecting gate lines 112 and data lines 114 define a number of pixel units 120 therebetween. The first substrate also includes a number of thin film transistors (TFTs) 116 that function as switching elements, and a number of pixel electrodes 118. Each TFT 116 is provided in a respective pixel unit 120, in the vicinity of a respective point of intersection of the gate lines 112 and the data lines 114.

The second substrate includes a number of common electrodes 119 generally opposite to the pixel electrodes 118. In particular, the common electrodes 119 are formed on a surface of the second substrate nearest to the first substrate, and are made from a transparent material such as ITO (Indium-Tin Oxide) and the like.

FIG. 3 is an equivalent circuit diagram of one pixel unit 120 of the LCD 100. A gate electrode 1162, a source electrode 1163, and a drain electrode 1164 of the TFT 116 are connected to the corresponding gate line 112, the corresponding data line 114, and a corresponding pixel electrode 118 respectively. Liquid crystal material sandwiched between the pixel electrode 118 and the corresponding common electrode 119 on the second substrate (not shown) is represented as a liquid crystal capacitor $C_{lc}$. $C_{sd}$ is a parasitic capacitor formed between the source electrode 1163 and the drain electrode 1164 of the TFT 116. "R" represents an essential resistance of the data line 114.

When the LCD 100 works, in each pixel unit 120, a scanning signal generated by a corresponding one of the gate driving circuits 150 is provided to the gate electrode 1162 of the TFT 116. Thus the TFT 116 is switched on. At the same time, gradation voltage generated by a corresponding one of the data driving circuits 130 is provided to the pixel electrode 118 via the corresponding data line 114 and the activated TFT 116 in series.

Because the essential resistance "R" of the data line 114 and the parasitic capacitor $C_{sd}$ form a resistance-capacitance (RC) delay circuit (not labeled), the gradation voltage transmitted on the data line 114 is delayed and reduced by the RC delay circuit, as shown in FIG. 4. $V_{d1}$ represents the gradation voltage on a point of one of the data line 114 that is near one of the gate driving circuits 130, and $V_{d2}$ represents the gradation voltage on another point of the same data line 114 that is far from the gate driving circuit 130. As seen, the gradation voltage $V_{d2}$ is delayed compared to the gradation voltage $V_{d1}$. The delay of the gradation voltage is determined by the essential resistance "R" of the data line 114 and the capacitance of the parasitic capacitor $C_{sd}$. When the size of the display screen of the LCD 100 is large, the signal delay of the gradation voltage becomes correspondingly longer. Since the gradation voltage provided to the pixel unit 120 far from the gate driving circuit 130 is partly delayed by the RC delay circuit, the brightness of the LCD 100 far from the gate driving circuit 130 is correspondingly reduced. That is, the brightness of the LCD 100 is nonuniform, and the quality of images displayed by the LCD 100 may be unsatisfactory.

It is desired to provide an LCD which can overcome the above-described deficiencies.

SUMMARY

In one preferred embodiment, an LCD includes an LCD panel including a plurality of display regions arranged consecutively in a line; a plurality of gate driving circuits respectively connected to the plurality of display regions and configured for providing scanning signals to scan the display regions; at least one data driving circuit configured for generating gradation voltages and providing the gradation voltages to a corresponding display region when the display region is being scanned; and a delay control circuit connected between the at least one data driving circuit and the display regions and configured for delaying the gradation voltages provided to each display region. A first delay value of the gradation voltages is generated by the delay control circuit when the gradation voltages are applied to one of the display regions. A second delay value of the same gradation voltages is generated when the gradation voltages are transmitted from the gate driving circuit to the same one of the display regions. A sum of the first delay value and the second delay value of the gradation voltages is finally provided to the same one of the display regions. The sum of the first delay value and the second delay value for each of the display regions is approximately constant for all of the display regions.

Other novel features and advantages will become more apparent from the following detailed description when taken in conjunction with the accompanying drawings.

DETAILED DESCRIPTION OF PREFERRED EMBODIMENTS

Reference will now be made to the drawings to describe various embodiments of the present invention in detail.

Figure 1:
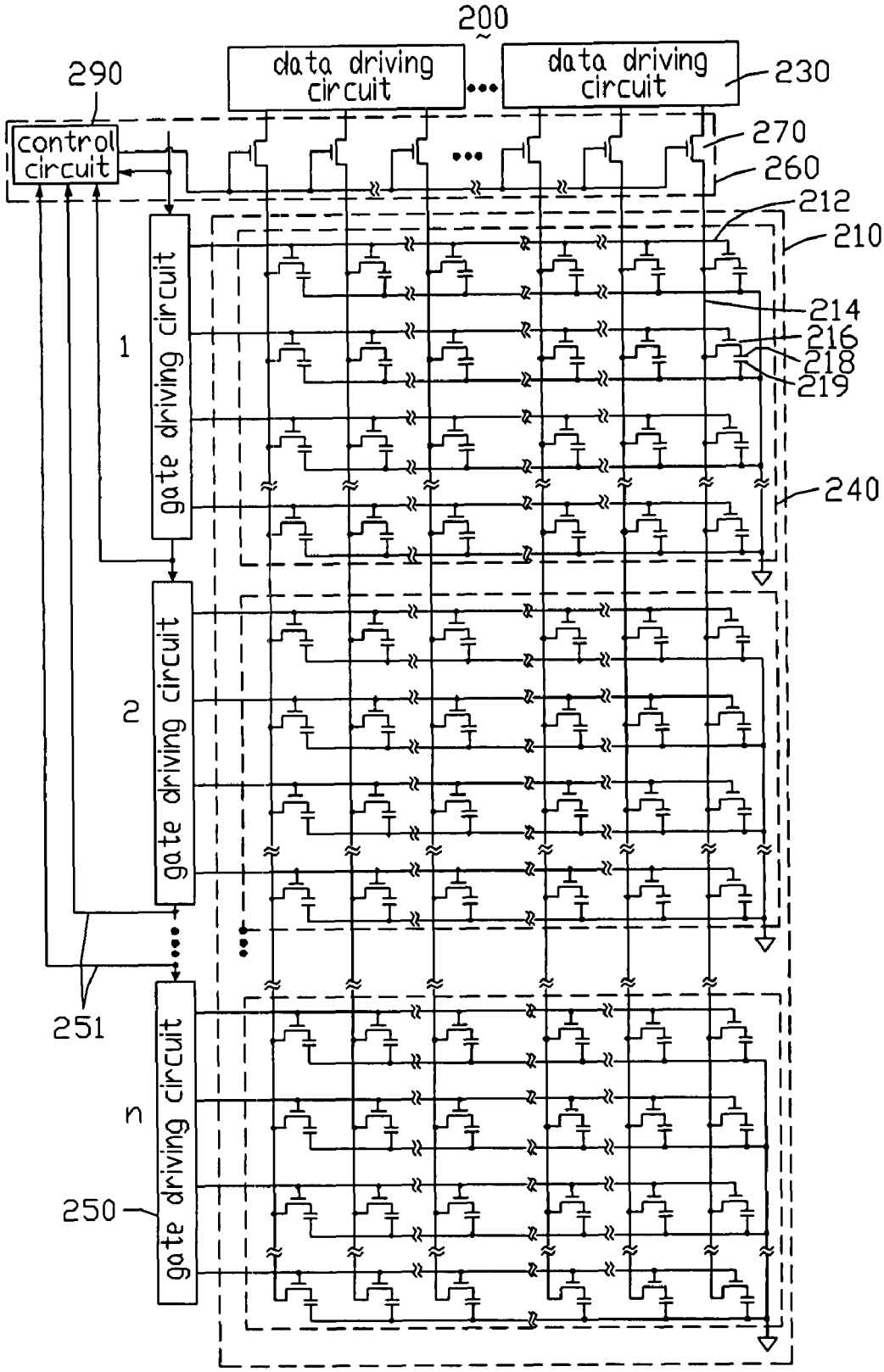
FIG. 1 is essentially an abbreviated circuit diagram of an LCD according to an exemplary embodiment of the present invention.
Figure 2:
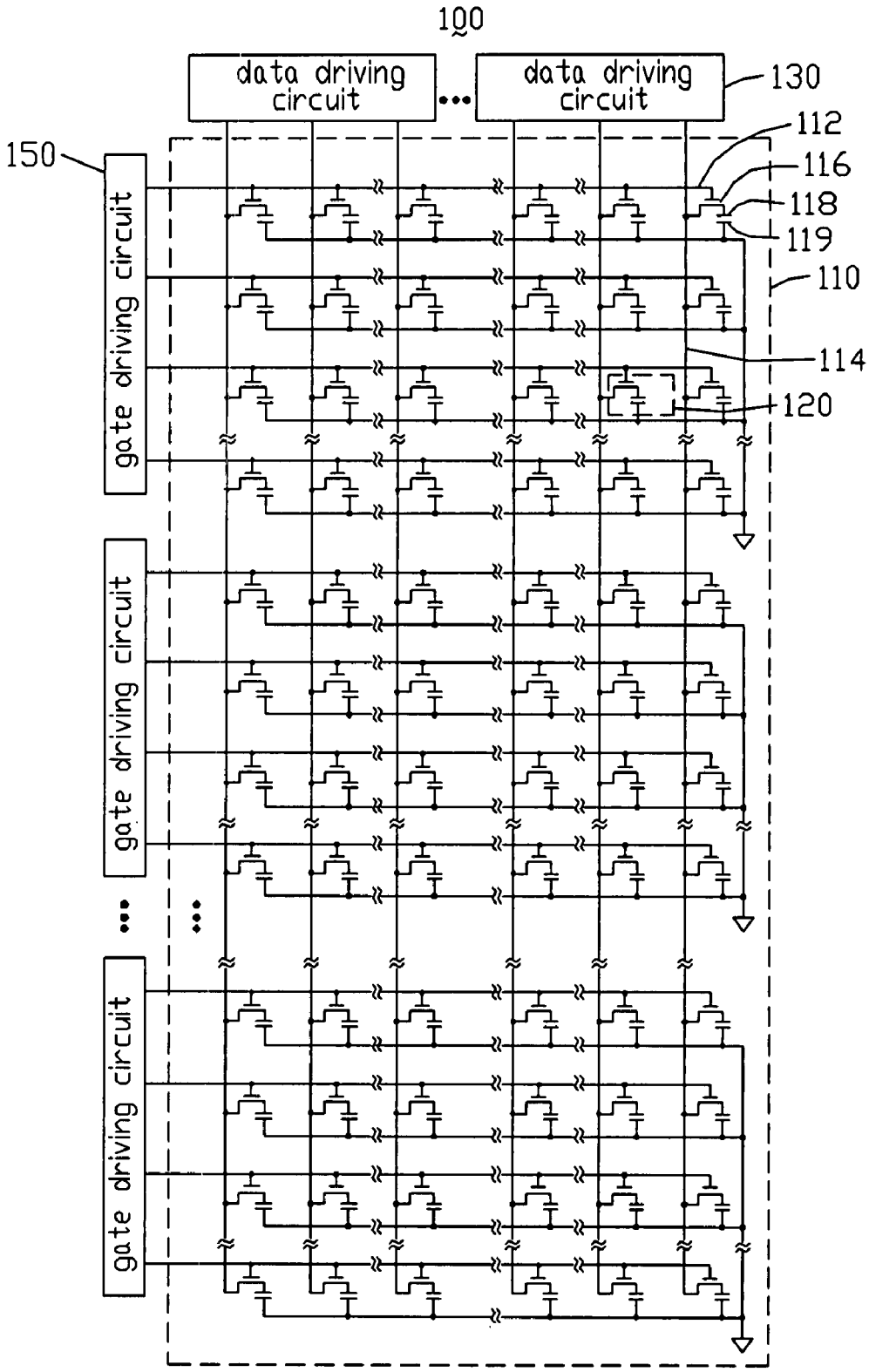
FIG. 2 (RELATED ART)
FIG. 2 is essentially an abbreviated circuit diagram of a conventional LCD.
Figure 3:
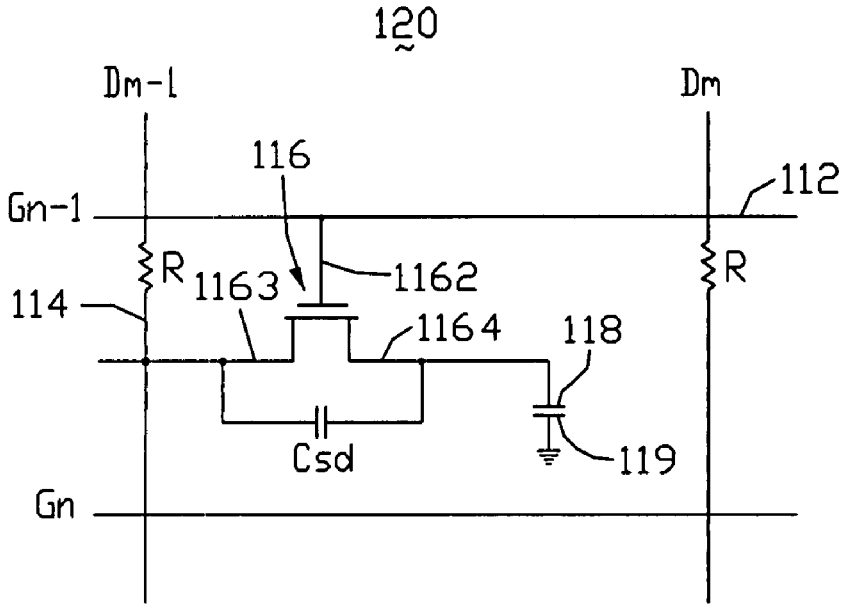
FIG. 3 (RELATED ART)
FIG. 3 is an equivalent circuit diagram of one pixel unit of the LCD of FIG. 2.
Figure 4:
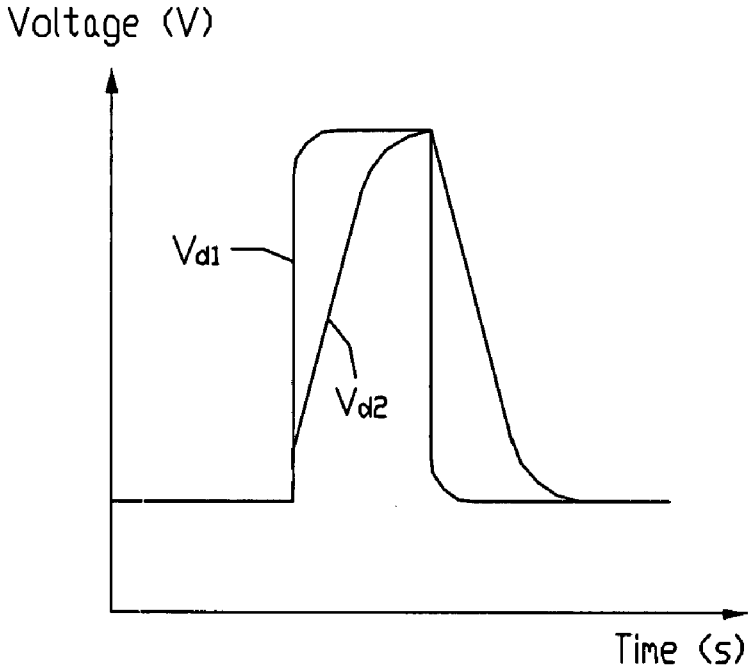
FIG. 4 (RELATED ART)
FIG. 4 is a graph of voltage versus time, showing gradation voltages at two different points along a length of a gate line of the LCD of FIG. 2.

Referring to FIG. 1, an LCD 200 according to a preferred embodiment of the present invention includes an LCD panel 210, a number of data driving circuits 230, a number n (where n is a natural number) of gate driving circuits 250, and a delay control circuit 260. The LCD panel 210 includes a first substrate (not shown), a second substrate (not shown) arranged parallel to the first substrate, and a liquid crystal layer (not shown) sandwiched between the first substrate and the second substrate. Liquid crystal material of the liquid crystal layer has anisotropic transmittance.

The first substrate includes a number of gate lines 212 that are parallel to each other and that each extend along a first direction, and a number of data lines 214 that are parallel to each other and that each extend along a second direction orthogonal to the first direction. The intersecting gate lines 212 and data lines 214 define a number of pixel units (not labeled) therebetween. The first substrate also includes a number of thin film transistors (TFTs) 216 that function as switching elements, and a number of pixel electrodes 218. Each TFT 216 is provided in a respective pixel unit, in the vicinity of a respective point of intersection of the gate lines 212 and the data lines 214.

The second substrate includes a number of common electrodes 219 generally opposite to the pixel electrodes 218. In particular, the common electrodes 219 are formed on a surface of the second substrate nearest to the first substrate, and are made from a transparent material such as ITO (Indium-Tin Oxide) and the like.

Each gate driving circuit 250 includes a number of output terminals (not labeled) respectively connected to the gate lines 212, and a trigger signal output terminal 251. Each region of the LCD panel 210 corresponding to the gate lines 212 that are connected to one same gate driving circuit 250 is defined as a display region 240. Thus a number n (where n is a natural number) of display regions are defined sequentially starting from adjacent to the data driving circuits 230 and progressing farther and farther away from the data driving circuits 230.

The delay control circuit 260 includes a control circuit 290, a number of delay transistors 270, and a number of control signal inputs (not labeled) connected to the trigger signal output terminals 251. Each delay transistor 270 includes a gate electrode (not labeled) connected to the control circuit 290, a drain electrode (not labeled) connected to the corresponding data line 214, and a souce electrode (not labeled).

Each data driving circuit 230 includes a number of output terminals respectively connected to the source electrodes of corresponding of the delay transistors 270. Thus each output terminal of the data driving circuits 230 is connected to the corresponding data line 212 via one of the delay transistors 270. The data driving circuits 230 generate a number of gradation voltages, and sequentially provide the gradation voltages to the number n of display regions 240 when the number n of display regions 240 is sequentially scanned by the gate driving circuits 250.

When the LCD 200 works, an external circuit (not shown) provides a start signal to the number 1 gate driving circuit 250 and the control circuit 290 of the delay control circuit 260. The number 1 gate driving circuit 250 generates a number of scanning signals, and sequentially provides the scanning signals to the gate lines 212 of the number 1 display region 240 for switching on the corresponding TFTs 216. At the same time, the control circuit 290 of the delay control circuit 260 generates a first control voltage $V_1$ and transmits the first control voltage to the delay transistors 270 of the delay control circuit 260. The data driving circuits 230 generate a number of gradation voltages, and sequentially provide the gradation voltages to the corresponding pixel electrodes 218 of the number 1 display region 240 via the delay transistors 270, the data lines 214, and the activated TFTs 216 in series.

After all the gradation voltages corresponding to the number 1 display region are completely provided to the pixel units of the number 1 display region, the number 1 gate driving circuit 250 applies a control signal to the number 2 gate driving circuit 250 and the control circuit 290 of the delay control circuit 260. The number 2 gate driving circuit 250 generates a number of scanning signals, and sequentially provides the scanning signals to the gate lines 212 of the number 2 display region 240 for switching on the corresponding TFTs 216. At the same time, the control circuit 290 of the delay control circuit 260 generates a second control voltage $V_2$ ($V_2>V_1$) and transmits the second control voltage to the delay transistors 270 of the delay control circuit 260 in response to the control signal generated by the number 1 gate driving circuit 250. The data driving circuits 230 generate a number of gradation voltages, and sequentially provide the gradation voltages to the corresponding pixel electrodes 218 of the number 2 display region 240 via the delay transistors 270, the data lines 214, and the activated TFTs 216 in series.

After all gradation voltages corresponding to the number n-1 display region are completely provided to the pixel units of the number n-1 display region, the number n-1 gate driving circuit 250 applies a control signal to the number n gate driving circuit 250 and the control circuit 290 of the delay control circuit 260. The number n gate driving circuit 250 generates a number of scanning signals, and sequentially provides the scanning signals to the gate lines 212 of the number n display region 240 for switching on the corresponding TFTs 216. At the same time, the control circuit 290 of the delay control circuit 260 generates a number n control voltage $V_n(V_n>V_{n-1})$ and transmits the number n control voltage to the delay transistors 270 of the delay control circuit 260 in response to the control signal generated by the number n-1 gate driving circuit 250. The data driving circuits 230 generate a number of gradation voltages, and sequentially provide the gradation voltages to the corresponding pixel electrodes 218 of the number n display region 240 via the delay transistors 270, the data lines 214, and the activated TFTs 216 in series.

To summarize operation, when the gate driving circuits 250 from number 1 to number n work sequentially, the control circuit 290 of the delay control circuit 260 provides gradually increased control voltages $V_1 \ldots V_n$ to the delay transistors 270 for delaying the gradation voltages sequentially provided to the corresponding display regions 240. As a distance of the display region 240 to the data driving circuits 230 is increased, a delayed value of the gradation voltage provided to the corresponding display region 240 is gradually reduced.

Because the LCD 200 includes the delay control circuit 260, the gradation voltages sequentially provided to the corresponding display regions 240 can be delayed according to the distances of the display regions 240 relative to the data driving circuits 230. The delayed value $\Delta V_1$ of the gradation voltages generated by the delay control circuit 260 is gradually reduced with increasing distance of the corresponding display region 240 from the data driving circuits 230. At the same time, an essential resistance of each data line 214 and a parasitic capacitor connected to the data line 214 form an RC delay circuit (not labeled). The gradation voltage transmitted on the data line 214 is delayed and reduced by the RC delay circuit. A delayed value $\Delta V_2$ of the gradation voltage generated by the RC delay circuit is gradually increases with increasing distance of the corresponding display region 240 from the data driving circuits 230. Thus, the gradation voltages provided to each display region 240 includes a first delay value $\Delta V_1$ and a second delay value $\Delta V_2$. The amount of the first delay value $\Delta V_1$ and the second delay value $\Delta V_2$ is approximately equal to a constant. Thus, the brightness of a display region 240 of the LCD 200 far from the data driving circuits 230 is approximately equal to that of a display region 240 of the LCD 200 near the data driving circuits 230. Therefore, the brightness of LCD 200 can be uniform.

In an alternative embodiment of the present invention, the data driving circuits 230 can be replaced by a single data driving circuit.

It is to be understood, however, that even though numerous characteristics and advantages of preferred and exemplary embodiments have been set out in the foregoing description, together with details of the structures and functions of the embodiments, the disclosure is illustrative only; and that changes may be made in detail, especially in matters of arrangement of parts within the principles of present invention to the full extent indicated by the broad general meaning of the terms in which the appended claims are expressed.

What is claimed is:

1. A liquid crystal display (LCD) comprising:

an LCD panel comprising a plurality of display regions arranged consecutively in a line;

a plurality of gate driving circuits respectively connected to the plurality of display regions and configured for providing scanning signals to scan the display regions;

at least one data driving circuit configured for generating gradation voltages and providing the gradation voltages to a corresponding display region when the display region is being scanned; and a delay control circuit connected between the at least one data driving circuit and the display regions and configured for delaying the gradation voltages provided to each display region, the delay control circuit comprising a plurality of delay transistors for delaying the gradation voltages, each one of the plurality of delay transistors comprising a gate electrode for receiving a control voltage, a drain electrode connected to the display region, and a source electrode connected to the data driving circuit;

wherein a first delay value of the gradation voltages is generated by the delay control circuit when the gradation voltages are applied to one of the display regions, a second delay value of the same gradation voltages being generated when the gradation voltages are transmitted from the gate driving circuit to the same one of the display regions, and a sum of the first delay value and the second delay value of the gradation voltages is finally provided to the same one of the display regions; and the sum of the first delay value and the second delay value for each of the display regions is approximately constant for all of the display regions.

2. The LCD as claimed in claim 1, wherein the first delayed value of the gradation voltage generated by the delay control circuit is gradually reduced with increasing distance of the corresponding display region from the at least one data driving circuit.

3. The LCD as claimed in claim 1, wherein the delay control circuit further comprises a control circuit connected to gate electrodes of the delay transistors and configured for providing the control voltage to each delay transistor in response to a signal received from a corresponding display region that has just finished display.

4. The LCD as claimed in claim 3, wherein the LCD panel comprises a first substrate, a second substrate arranged parallel to the first substrate, and a liquid crystal layer sandwiched between the first substrate and the second substrate.

5. The LCD as claimed in claim 4, wherein the first substrate comprises a plurality of gate lines that are parallel to each other and that each extend along a first direction, a plurality of data lines that are parallel to each other and that each extend along a second direction orthogonal to the first direction, a plurality of thin film transistors (TFTs) each provided in the vicinity of a respective point of intersection of the gate lines and the data lines, and a plurality of pixel electrodes corresponding to the TFTs.

6. The LCD as claimed in claim 5, wherein the plurality of gate driving circuits are connected to the gate lines of the plurality of display regions, and the at least one data driving circuit is connected to the data lines respectively via the plurality of delay transistors.

7. The LCD as claimed in claim 6, wherein the control voltages provided to the delay transistors are gradually increased with increasing distance of the corresponding display region from the at least one data driving circuit.

8. The LCD as claimed in claim 7, wherein when the LCD begins working, an external circuit provides a start signal to the control circuit of the delay control circuit and a first one of the gate driving circuits that is nearest to the at least one data driving circuit.

9. The LCD as claimed in claim 8, wherein there are a total of "m" display regions and a total of "m" gate driving circuits, "m" being a natural number, and after all gradation voltages corresponding to an (n−1)th (n=2, 3, 4. . . m) one of the display regions have been completely outputted from the at least one data driving circuit, an (n−1)th (n=2, 3, 4. . . m) one of the gate driving circuits applies a control signal to an nth one of the gate driving circuits and the control circuit of the delay control circuit.

10. A driving method for a liquid crystal display, the liquid crystal display comprising a number n (where n is a nature number) of gate driving circuits, at least one data driving circuit, a delay control circuit, and the number n of display regions arranged consecutively in a line with progressively increasing distance away from the at least one data driving circuit, the delay control circuit comprising a plurality of delay, each one of the plurality of delay transistors comprising a gate electrode for receiving a control voltage, a drain electrode connected to the display region, and a source electrode connected to the data driving circuit, the driving method comprising:

providing scan signals to scan one of the display regions;

generating gradation voltages corresponding to the same one of the display regions; and delaying the gradation voltages according to a distance of the same one of the display regions from the at least one data driving circuit.

11. The driving method as claimed in claim 10, wherein a delayed value of the gradation voltages applied to each of the display regions is progressively reduced with increasing the distance of the display regions from the at least one data driving circuit.

12. The driving method as claimed in claim 10, wherein further comprising, when the LCD begins to work, providing a start signal to the delay control circuit and a first one of the gate driving circuits that is nearest to the at least one data driving circuit.

13. The driving method as claimed in claim 12, wherein there are a total of "m" display regions and a total of "m" gate driving circuits, "m" being a natural number, and after all gradation voltages corresponding to an (n−1)th (n=2, 3, 4. . . m) of the display regions have been completely outputted from the at least one data driving circuit, an (n−1)th of the gate driving circuits applies a control signal to an nth one of the gate driving circuits and the delay control circuit.

14. The driving method as claimed in claim 13, wherein the gradation voltages are generated when the control signal or the start signal is provided to the corresponding gate driving circuit.

15. The driving method as claimed in claim 14, wherein a delayed value is generated by the delay control circuit according to the received control signal generated by the corresponding gate driving circuit or the received start signal.

16. The driving method as claimed in claim 15, wherein the delay control circuit further comprises a control circuit connected to gate electrodes of the delay transistors and configured for providing the control voltage to each delay transistor in response to the received control signal or the received start signal.

17. The driving method as claimed in claim 16, wherein the control voltages provided to the delay transistors are gradually increased with increasing distance of the corresponding display region from the at least one data driving circuit, the corresponding display region being the display region that is connected to the gate driving circuit that generates the control signal.

18. A liquid crystal display (LCD) comprising:

at least one data driving circuit configured for generating gradation voltages;

an LCD panel comprising a plurality of display regions being progressively more distant from the at least one data driving circuit;

a plurality of gate driving circuits respectively connected to the plurality of display regions and configured for providing scanning signals to scan the display regions, the gradation voltages being providing to a corresponding display region when the display region is being scanned;

a delay control circuit connected between the at least one data driving circuit and the display region nearest to the at least one data driving circuit, and being configured for delaying the gradation voltages provided to each display region, the delay control circuit comprising a plurality of delay, each one of the plurality of delay transistors comprising a gate electrode for receiving a control voltage, a drain electrode connected to the display region, and a source electrode connected to the data driving circuit, wherein the delaying of the gradation voltages progressively reduces for the display regions, from the display region nearest to the at least one data driving circuit to the display region farthest from the at least one data driving circuit.

* * * * *